US008308161B2

(12) United States Patent
Sekiya

(10) Patent No.: US 8,308,161 B2
(45) Date of Patent: Nov. 13, 2012

(54) MOTOR CONTROL APPARATUS AND IMAGE FORMING APPARATUS

(75) Inventor: Takeshi Sekiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 12/845,597

(22) Filed: Jul. 28, 2010

(65) Prior Publication Data

US 2011/0024980 A1 Feb. 3, 2011

(30) Foreign Application Priority Data

Jul. 30, 2009 (JP) ..... 2009-178016

(51) Int. Cl.
*B65H 5/00* (2006.01)

(52) U.S. Cl. ..... 271/264; 318/696

(58) Field of Classification Search ..... 271/264; 318/685, 696

See application file for complete search history.

(56) References Cited

U.S. PATENT DOCUMENTS 6,144,184 A * 11/2000 Yamaguchi ..... 318/696
7,197,275 B2 * 3/2007 Yasui ..... 399/396

FOREIGN PATENT DOCUMENTS

JP 62-002895 A 1/1987
JP 2002-366001 A 12/2002

OTHER PUBLICATIONS

Omega, Introduction to Step Motors [online], Jan. 27, 2008 [retrieved Jan. 12, 2012], Retrieved from http://www.omega.com/auto/REF_IntroStepMotors.pdf.*

Fredrik Eriksson, Industrial Circuits Application Note Stepper Motor Basics [online], Mar. 6, 1998 [retrieved Jan. 12, 2012], Retrieved from http://www.solarbotics.net/library/pdflib/pdf/motorbas.pdf.*

* cited by examiner

*Primary Examiner* — Michael McCullough

(74) *Attorney, Agent, or Firm* — Canon USA Inc. IP Division

(57) ABSTRACT

A motor control apparatus includes a stepping motor which includes a rotor and a stator, and a control unit, wherein, in a case where the stator is excited in a second excitation pattern before rotation drive of the stepping motor is started in a first excitation pattern, the control unit performs phase adjustment of the rotor by exciting the stator in the first excitation pattern by one cycle or a plurality of cycles of the first excitation pattern with a drive pulse of a frequency within a self-start range of the stepping motor, and starts the rotation drive of the stepping motor by exciting the stator in the first excitation pattern to a target frequency which exceeds a self-start frequency of the stepping motor by changing the drive pulses.

10 Claims, 6 Drawing Sheets

MOTOR CONTROL APPARATUS AND IMAGE FORMING APPARATUS

BACKGROUND OF THE INVENTION

1. Field of the Invention

The present invention generally relates to motor control and, more particularly, to a motor control apparatus and an image forming apparatus that drive a stepping motor in a plurality of excitation modes.

2. Description of the Related Art

An image forming apparatus such as a copying machine conveys recording paper in a speed suitable for each of various types of the recording paper or printing modes. For example, when thick paper is conveyed, the thick paper is conveyed at a speed half of a conveyance speed of plain paper. To drive rollers for conveying the recording paper, a stepping motor is often used. When the stepping motor is driven in two-phase excitation, high torque can be obtained. However, in the two-phase excitation, when the stepping motor is driven at a low speed, significant vibration occurs. To solve the problem, Japanese Patent Application Laid-Open No. 62-002895 discusses to drive a stepping motor in two-phase excitation when the motor is driven at a high speed and to drive the motor in one-two phase excitation when the motor is driven at a low speed.

However, when the stepping motor is driven in the two-phase excitation at the high speed and the motor is driven in the one-two phase excitation at the low speed, the following problems occur.

When a motor driver drives the stepping motor, the motor driver starts to excite a stator in a predetermined excitation pattern. When a rotor of the stepping motor is not positioned at an angle corresponding to an initial position in the excitation pattern, if the excitation is started in the predetermined excitation pattern, the rotor cannot follow the excitation of the stator and causes a loss of synchronization and vibration.

Such a phenomenon may occur when the excitation pattern is switched from the two-phase excitation to the one-two phase excitation or from the one-two phase excitation to the two-phase excitation at arbitrary timing.

When the stepping motor is driven, stopped, and restarted without switching an excitation method, the loss of synchronization and vibration can be prevented if the excitation phase at the time of the driving stop is stored and the excitation is restarted from the stored excitation phase. However, when the excitation method is switched, the excitation phases of before and after the switching do not correspond to one to one. Accordingly, the excitation cannot be restarted in the excitation method different from the previous excitation method by only storing the excitation phase at the time of the driving stop.

Especially, when an excitation phase at the time of the driving stop in the one-two phase excitation is a phase 1, and the excitation phase is switched to the two-phase excitation, the excitation phase (phase 1) at the driving stop does not correspond to the excitation phase (phase 2) at the driving restart. Accordingly, it is not possible to determine which phase is to be used as the phase 2 only from information about the excitation phase at the driving stop.

SUMMARY OF THE INVENTION

According to an aspect of the present invention, a motor control apparatus includes a stepping motor which includes a rotor and a stator, and a control unit configured to rotate the stepping motor by sequentially switching excitation of the stator in the stepping motor based on at least a predetermined first excitation pattern or a predetermined second excitation pattern that change corresponding to an input drive pulse, wherein, in a case where the stator is excited in the second excitation pattern before rotation drive of the stepping motor is started in the first excitation pattern, the control unit performs phase adjustment of the rotor by exciting the stator in the first excitation pattern by one cycle or a plurality of cycles of the first excitation pattern with a drive pulse of a frequency within a self-start range of the stepping motor, and starts the rotation drive of the stepping motor by exciting the stator in the first excitation pattern to a target frequency which exceeds a self-start frequency of the stepping motor by changing the drive pulses.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
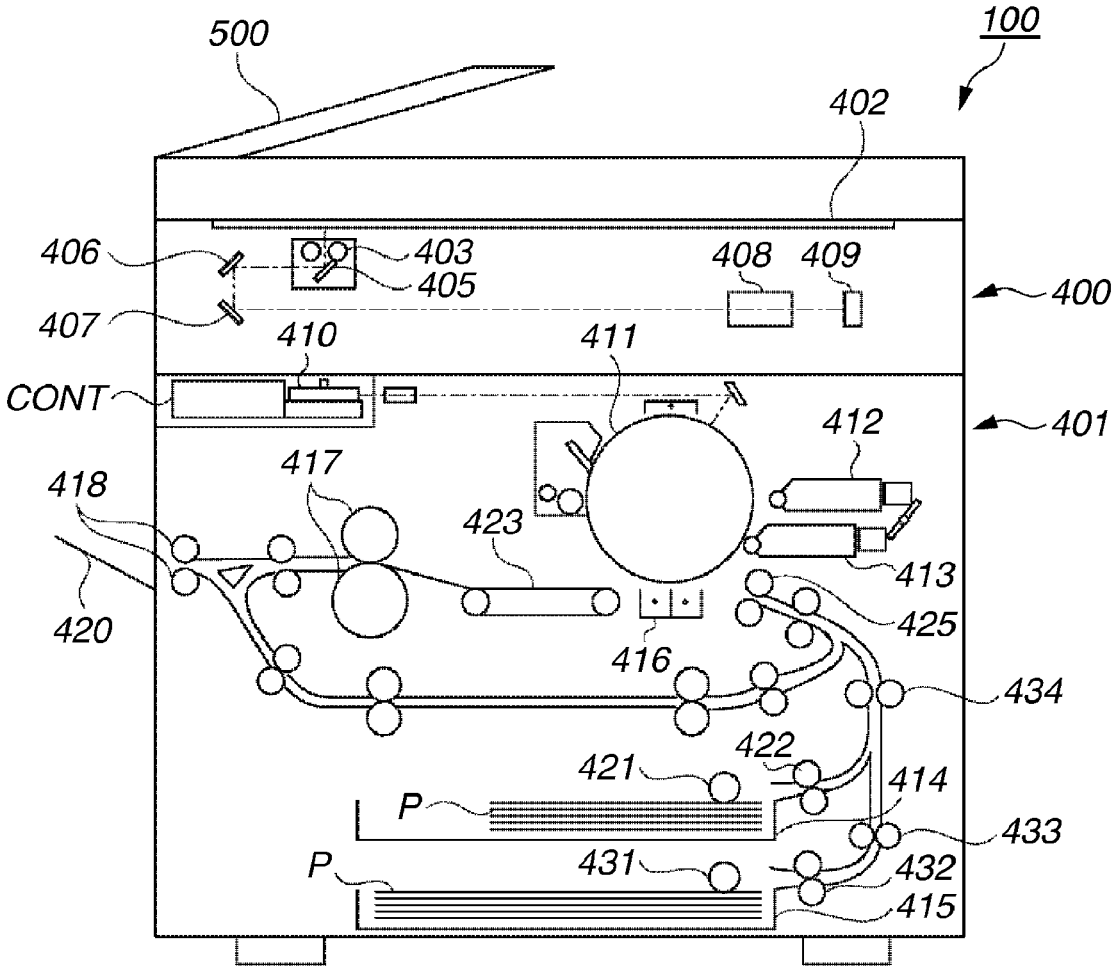
FIG. 1 is a cross sectional view illustrating an image forming apparatus according to an exemplary embodiment of the present invention.

FIG. 1 is a cross sectional view illustrating an image forming apparatus 100 according to an exemplary embodiment of the present invention. The image forming apparatus 100 includes a document reading unit 400, a printer 401, and an automatic document feeder (ADF) 500. The ADF 500 conveys documents one by one onto a platen glass 402. A lamp 403 and a scanning mirror 405 move along the document on the platen glass 402. Then, reflected light from the document passes via the scanning mirrors 405 to 407 and a lens 408 and is formed as an image on an image sensor unit 409. In such a way, the document is read. An exposure control unit 410 irradiates light beam corresponding to image data which is subjected to image processing in a controller unit (CONT) onto a photosensitive member 411. Developing units 412 and 413 develop an electrostatic latent image formed on the photosensitive member 411 by the light beam with a developer (toner) of a predetermined color.

Sheets of recording paper P stacked and stored in recording paper storing units 414 and 415 are separated one by one by pickup rollers 421 and 431. The separated recording paper P is conveyed to a registration roller 425 by feeding rollers 422, 432, 433, and 434. In synchronization with a timing of a leading edge of the image formed on the photosensitive member 411, the recording paper P is conveyed to a transfer separation charging unit 416 by the registration roller 425. The transfer separation charging unit 416 transfers the toner image developed on the photosensitive member 411 onto the recording paper P, and then separates the recording paper P from the photosensitive member 411. A fixing unit 417 fixes the toner image on the recording paper P conveyed by a conveyance belt 423 from the transfer separation charging unit 416. A discharge roller 418 discharges the recording paper P after fixing processing by the fixing unit 417 onto a tray 420. When the recording paper P is thick paper (second recording paper) that is thicker than plain paper (first recording paper), the photosensitive member 411 is rotated at a speed half of the speed in the case of the plain paper (paper other than the thick paper) in order to form the image at the half speed. Therefore, the recording paper P is also conveyed at the speed same as the peripheral speed of the photosensitive member 411. The thick paper is conveyed at the speed half of that of the plain paper because the thick paper needs more heat than plain paper to fix the image.

Figure 2:
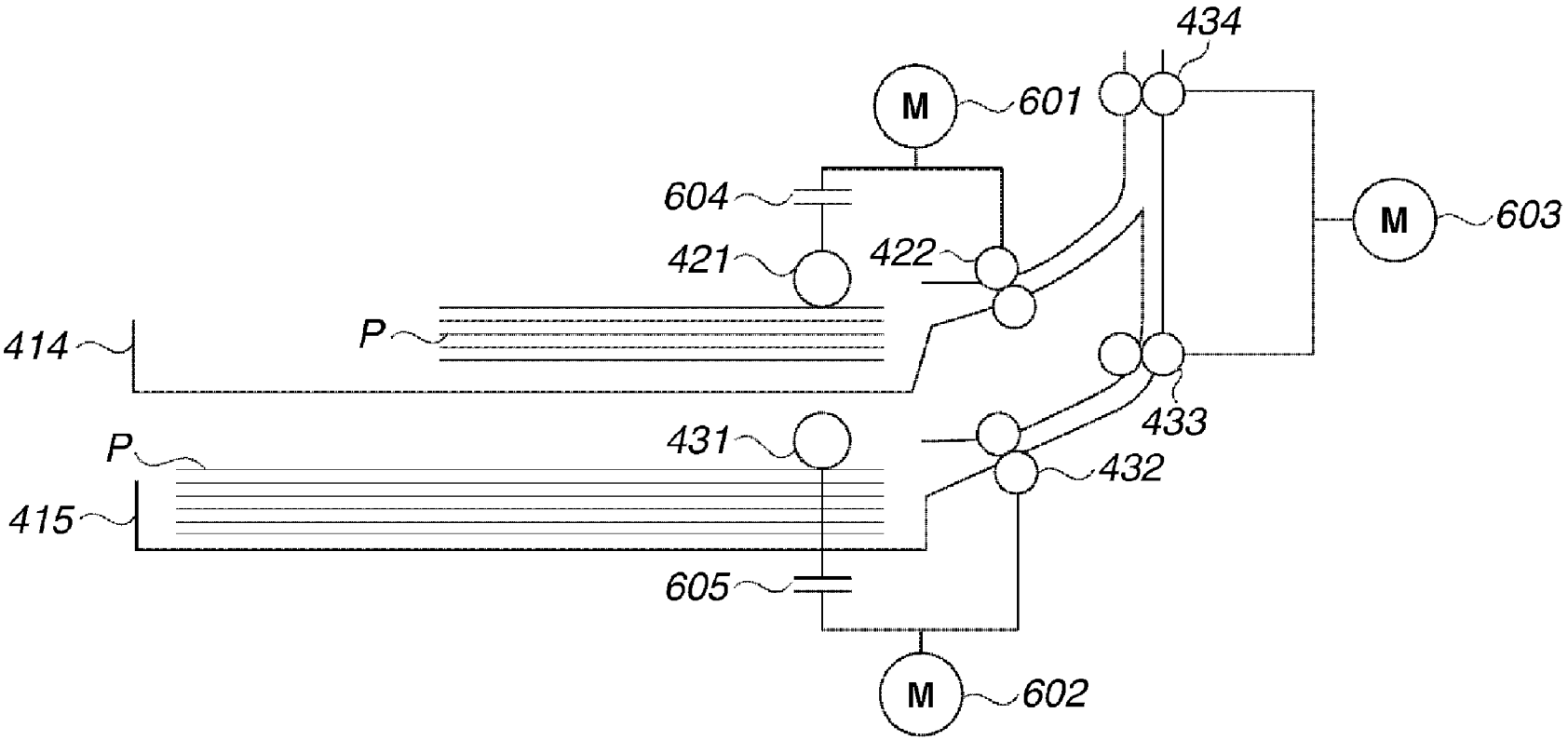
FIG. 2 is a drive block diagram illustrating a paper feeding unit of the image forming apparatus of FIG. 1.

FIG. 2 is a drive block diagram illustrating the pickup rollers 421 and 431, and the feeding rollers 422, 432, 433, and 434. The pickup roller 421 and the feeding roller 422 in the recording paper storing unit 414 are driven by a motor 601. The pickup roller 431 and the feeding roller 432 in the recording paper storing unit 415 are driven by a motor 602. The feeding rollers 433 and 434 are driven by a motor 603. These three motors 601, 602, and 603 are stepping motors, and can be individually driven (accelerated, decelerated, or stopped). The motors 601, 602, and 603 can be driven in two-phase excitation or one-two phase excitation. When plain paper is conveyed, the excitation mode of the motors 601, 602, and 603 are set to the two-phase excitation. When thick paper is conveyed, the excitation mode of the motors 601, 602, and 603 are set to the one-two phase excitation. By the operation, when thick paper is conveyed, the paper is conveyed at the speed half of the speed of the plain paper conveyance, and vibration caused by low-speed driving can be reduced. Further, when plain paper is conveyed, a torque necessary for high-speed driving can be ensured. Clutches 604 and 605 transmit or disconnect driving force of the motors to the pickup rollers 421 and 431.

Figure 3:
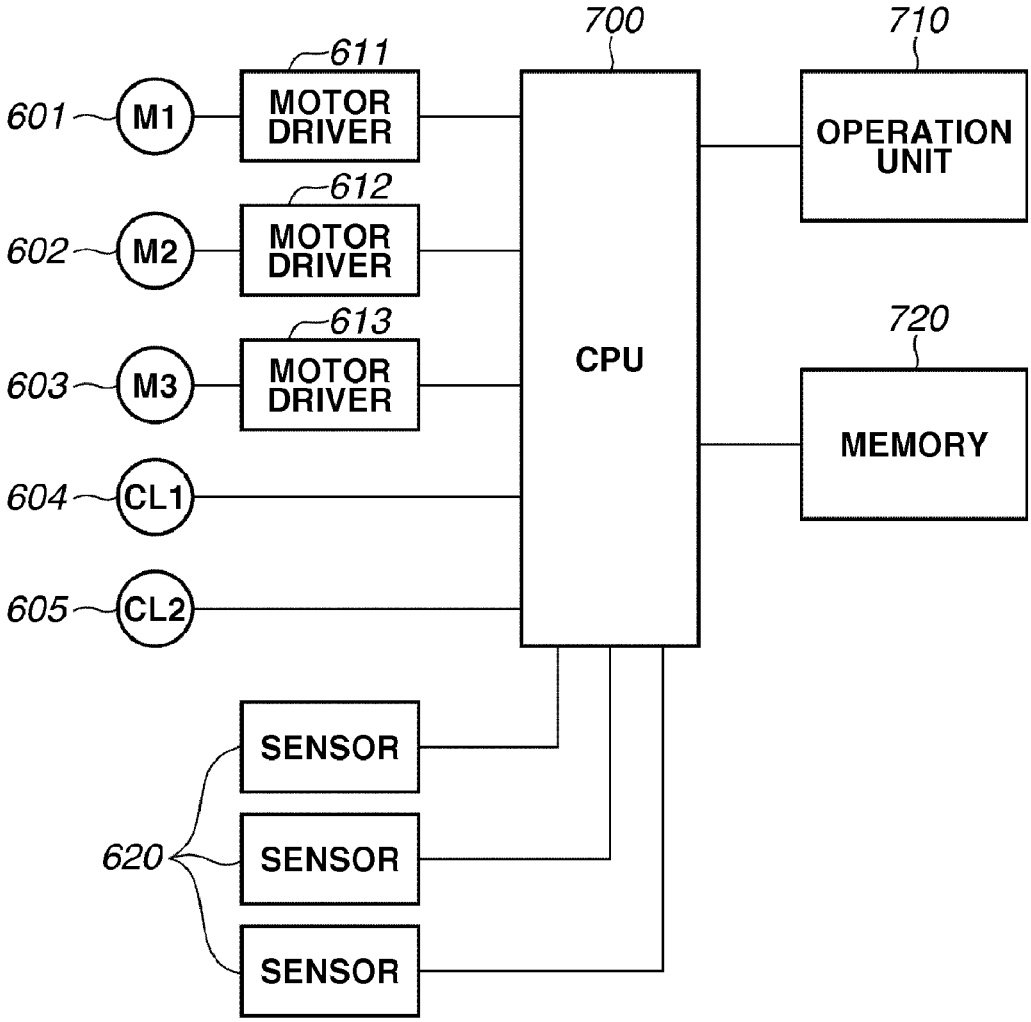
FIG. 3 is a control block diagram illustrating the paper feeding unit of the image forming apparatus of FIG. 1.

FIG. 3 is a control block diagram illustrating the paper feeding unit including the motors 601, 602, and 603. In response to an instruction from a central processing unit (CPU) 700, motor drivers 611, 612, and 613 control excitation of each phase of the motors 601, 602, and 603 to rotatably drive the motors 601, 602, and 603, respectively. From an operation unit 710, a user performs selection of the recording paper storing units, selection of the operation modes, instruction to start the image formation operation, and the like. A memory 720 stores the recording paper storing unit and the operation mode set by the operation unit 710. According to the recording paper storing unit set by the operation unit 710, the CPU 700 selects a motor and a clutch to be driven and controlled. Further, based on the set operation mode, the CPU 700 selects an excitation method of the motor. Furthermore, at a timing corresponding to the start instruction that is input from the operation unit 710, the CPU 700 controls the motor and the clutch. Based on input from a sensor 620 that is provided in a recording paper conveyance path in the image forming apparatus, the CPU 700 determines each timing to accelerate or decelerate the respective motors.

Now, an operation to feed recording paper from the paper feeding unit is described below with reference to FIGS. 2 and 3. The paper feeding operation from the recording paper storing unit 414 is performed as follows. An uppermost sheet of the recording paper stacked in the recording paper storing unit 414 is separated by the pickup roller 421, and conveyed to the feeding roller 422. When a leading edge of the recording paper reaches at the feeding roller 422, the clutch 604 disconnects the driving force to the pickup roller 421 in order not to separate the next recording paper, so that the pickup roller 421 stops. The first recording paper conveyed by the feeding roller 422 is further conveyed to an image forming unit by the feeding roller 434. The paper feeding operation from the recording paper storing unit 415 can be operated as similar to the above operation.

Figure 4A:
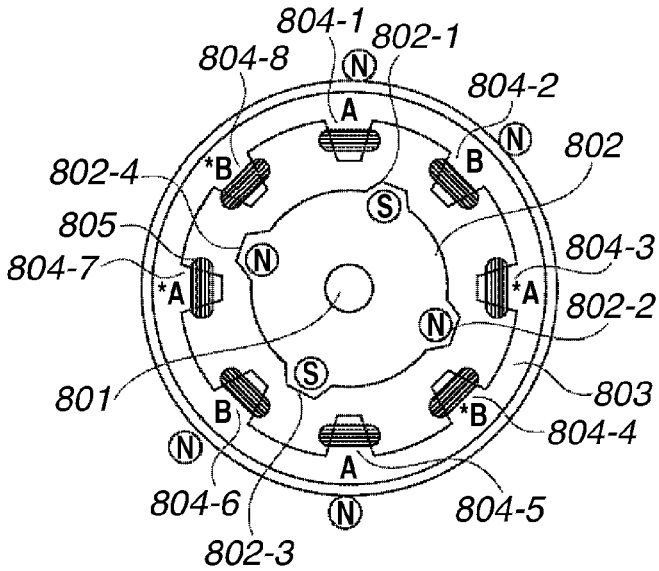
FIGS. 4A to 4C illustrate a structure of a stepping motor according to an exemplary embodiment of the present invention.
Figure 4B:
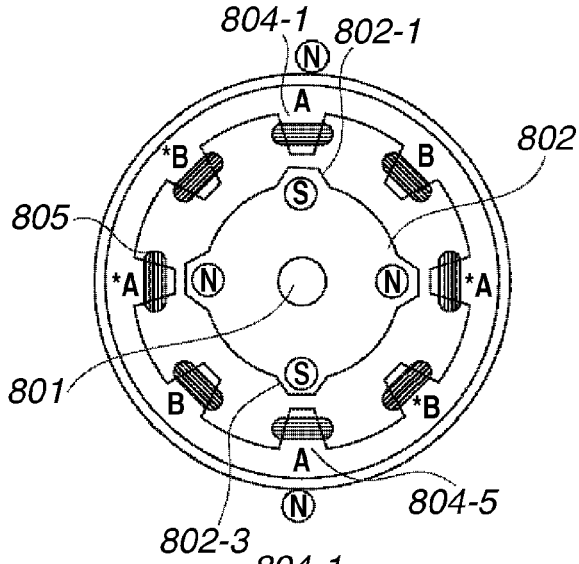
Figure 4C:
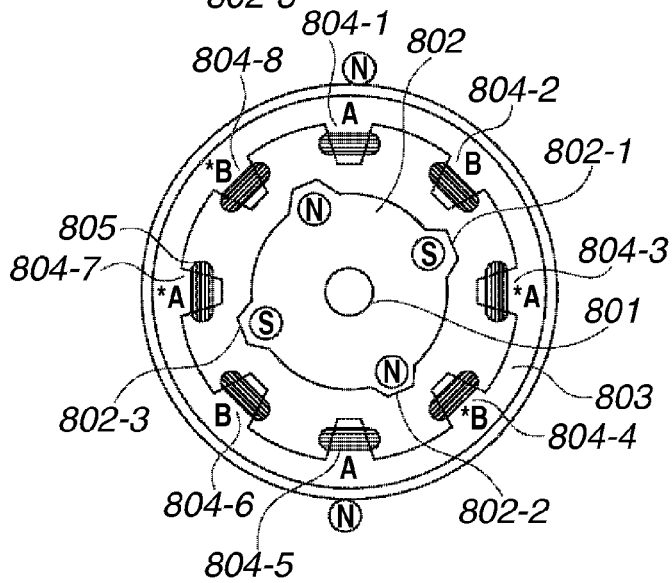

FIGS. 4A to 4C illustrate a structure of the stepping motor which is employed in the motors 601 to 603. A stator 803 is arranged such that the stator surrounds the periphery of a rotor 802 that is connected to a shaft 801. The stator 803 has stator poles (hereinafter, referred to as poles) 804 (804-1 to 804-8). The poles 804-1 to 804-8 are arranged such that the poles protrude toward the rotor 802. Each of the poles 804-1 to 804-8 has a coil 805 wound therearound. The poles 804-1 and 804-5 have phase-A coils. The poles 804-3 and 804-7 have phase-*A coils. The poles 804-2 and 804-6 have phase-B coils. The poles 804-4 and 804-8 have phase-*B coils. When an electric current is applied to the phase A, the poles 804-1 and 804-5 that correspond to the phase A are excited. When the electric current is applied to the phase *A, the poles 804-3 and 804-7 that correspond to the phase *A are excited. The phase B is excited similarly to the phase A.

FIG. 4A illustrates an initial position of the rotor 802 in a two-phase excitation mode. In this mode, the pole 804-1 of the phase A and the pole 804-2 of the phase B are excited and become the north pole. Then, a tooth 802-1 which is the south pole of the rotor 802 is attracted by the poles 804-1 and 804-2, and comes to rest at the midpoint therebetween. Similarly to the above, a tooth 802-3 of the rotor 802 is attracted by the poles 804-5 and 804-6, and comes to rest at the midpoint therebetween. When the motor is driven in the two-phase excitation, the coils of the stator 804 are sequentially excited (the excitation is sequentially switched) from the above described state, in the order of the phase A and phase B, the phase B and phase *A, the phase *A and phase *B, and, the phase *B and phase A. This excitation pattern is referred to as a two-phase excitation pattern. By sequentially exciting the coils by two phases, the teeth 802-1 to 802-4 of the rotor 802 are sequentially attracted by the poles 804-1 to 804-8 of the stator 804, so that the rotor 802 and the shaft 801 rotate in the clockwise direction.

FIG. 4B illustrates an initial position of the rotor 802 in a one-two phase excitation mode. In this mode, the poles 804-1 and 804-5 of the phase A are excited and become the north pole. Then, the teeth 802-1 and 802-3 of the rotor 802 are attracted respectively, and come to rest at positions facing the respective poles. When the motor is driven in the one-two phase excitation, the coils of the stator 804 are sequentially excited (the excitation is sequentially switched) from the above described state in the order of the phase A, the phase A and phase B, the phase B, the phase B and the phase *A, the phase *A, the phase *A and phase *B, the phase *B, and, the phase *B and phase A. This excitation pattern is referred to as a one-two phase excitation pattern. By alternatively repeating the excitation of the phase 2 and phase 1, the teeth 802-1 to 802-4 of the rotor 802 are sequentially attracted by the poles 804-1 to 804-8 of the stator 804, so that the rotor 802 and the shaft 801 rotate in the clockwise direction. In the one-two phase excitation, an advancing amount per a predetermined number of clocks of the rotor 802 is half of that of the two-phase excitation.

In the exemplary embodiment of the present invention, in the case of the two-phase excitation, the rotation drive is started from the state shown in FIG. 4A. In the case of the one-two phase excitation, the rotation drive is started from the state shown in FIG. 4B. As described above, the motor drivers 611 to 613 perform excitation in the predetermined patterns according to the excitation mode instructed by the CPU 700. Accordingly, the structures of the motor drivers are simple. On the other hand, a stoppage of drive of the motors or a change of the excitation modes of the motors may be performed at an arbitrary timing without waiting for the excitation pattern to be fully executed one cycle. Therefore, the phase of the rotor 802 may not correspond to that of the stator 804. As described above, when the rotation drive of the motors is restarted after the drive of the motors is stopped, the motor drivers 611 to 613 excite the motors in the above described pattern without considering in which phase the rotor 802 is stopped. The stepping motor is started by linearly increasing a frequency of a drive pulse to transfer the excitation pattern from a self-start frequency. Accordingly, if the stepping motor is started in a state that the phase of the rotor 802 is shifted, the rotor 802 cannot follow the excitation of the stator 804 and may cause a loss of synchronization and vibration. As described above, when a first excitation pattern is switched to a second excitation pattern, that is when the two-phase excitation is switched to the one-two phase excitation or when the one-two phase excitation is switched to the two-phase excitation, if the stepping motor is always started in the predetermined excitation pattern, a loss of synchronization and vibration may occur.

FIG. 4C illustrates an example of a phase of the rotor 802 when the motor is driven in the two-phase excitation and stopped at an arbitrary timing. From this state, if the rotor 802 is driven to rotate in the clockwise direction in the excitation pattern of the above described one-two phase excitation, first, the pole 804-1 becomes the north pole, and then, the poles 804-1 and 804-2 become the north pole. Accordingly, the rotor 802 cannot follow the excitation of the stator 804. If the rotor 802 is driven from this state, the tooth 802-1 of the rotor 802 is attracted to the pole 804-1, so that the rotor 802 may move in the counterclockwise direction. Accordingly, if the rotor 802 is started from this state in the above described excitation pattern, the frequency of the drive pulse in the excitation pattern of the stator 804 is linearly increased while the rotor 802 cannot follow the excitation of the stator 804. Thus, a loss of synchronization and vibration may occur. The loss of the synchronization and vibration may negatively affect the recording paper conveyance or the image formation.

To prevent the above described problem, in the exemplary embodiment, when the excitation mode of the stepping motor is switched (from the two-phase excitation to the one-two phase excitation, or from the one-two phase excitation to the two-phase excitation), phase adjustment of the rotor 802 and the stator 804 is performed before the stepping motor is started. In other words, before the rotation of the stepping motor is started, when the stator 804 is excited in a second excitation pattern that is different from a first excitation pattern which will be used in the next excitation, the phase adjustment of the rotor 802 and the stator 804 is performed. In the description, the phase adjustment means to fully execute the excitation pattern (one cycle of the excitation pattern) of the excitation mode to be used in the next excitation at a constant frequency (or a predetermined frequency) within a self-start frequency range to adjust the position of the rotor 802 to an excitation start position corresponding to the position in the excitation mode (excitation pattern) to be performed in the next excitation. Then, the stator 804 is excited based on the excitation pattern to start the rotation of the stepping motor while changing the frequency for changing the excitation pattern to a target frequency which exceeds the self-start frequency. If the excitation mode of the stepping motor is not switched, the above described phase adjustment may be performed before the stepping motor is started.

Figure 5A:
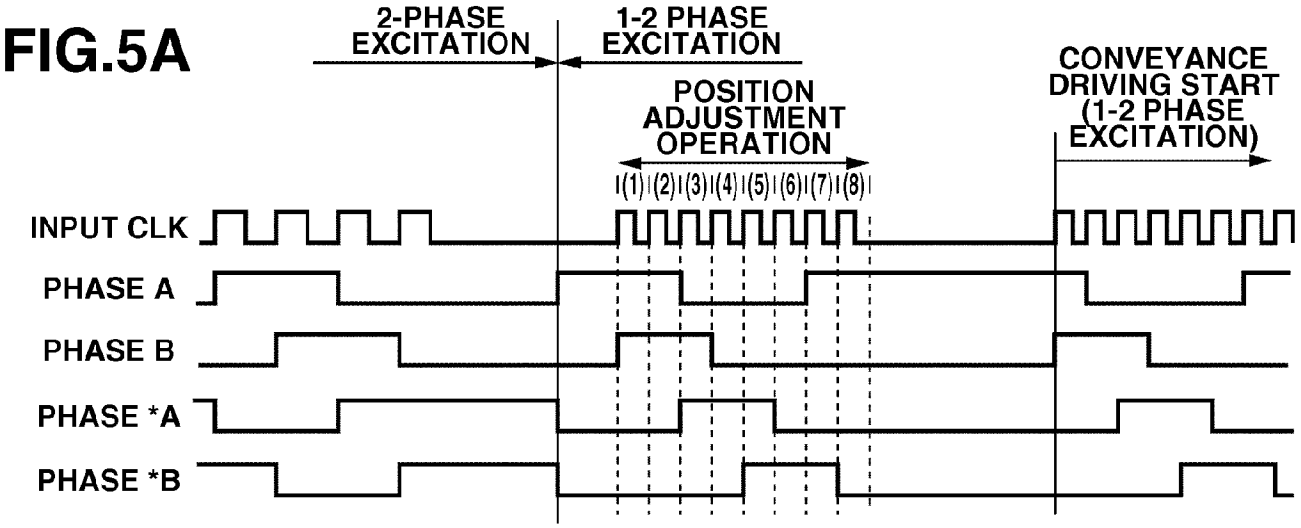
FIGS. 5A and 5B are sequence diagrams illustrating a phase adjustment operation according to an exemplary embodiment of the present invention.
Figure 5B:
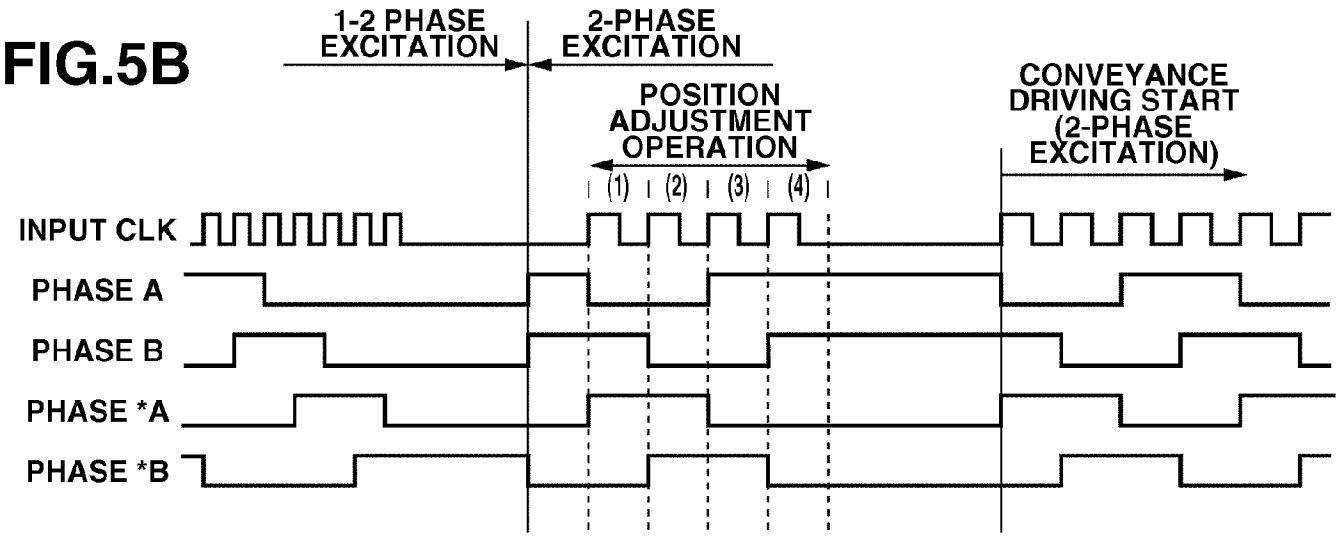

FIGS. 5A and 5B are sequence diagrams illustrating states of signals (input clocks (CLK)) input to the motor driver 611 and signals (phase A, phase B, phase *A, phase *B) output from the motor driver 611 when the excitation mode is switched and when the phase adjustment operation is performed.

FIG. 5A illustrates excitation control performed when the two-phase excitation is switched to the one-two phase excitation. The motor driver 611 excites the motor in the excitation pattern corresponding to the excitation mode instructed by the CPU 700. Then, the motor driver 611 transfers the excitation pattern every time an input clock is input from the CPU 700. When the two-phase excitation is switched to the one-two phase excitation, the phase adjustment to fully execute one cycle of the excitation pattern of the one-two phase excitation at a predetermined frequency within the self-start frequency range is performed before the motor is started in the one-two phase excitation. The CPU 700 stops the input clock at a timing the conveyance operation in the two-phase excitation is completed. Then, the CPU 700 instructs the motor driver 611 to perform the one-two phase excitation, and inputs 8 pulses of the input clock at the predetermined frequency within the self-start range to the motor driver 611.

In the one-two phase excitation, the one cycle of the excitation pattern consists of eight steps. Accordingly, by the transfer of the excitation pattern of the eight steps, the rotor 802 becomes the state shown in FIG. 4B. Then, the state corresponds to the phase of the excitation pattern at the start of the one-two phase excitation. Then, the CPU 700 lineally increases the frequency of the input clock from the self-start frequency to the target frequency.

The motor driver 611 drives the motor in the two-phase excitation until an instruction to switch the two-phase excitation to the one-two phase excitation is issued. After receiving the instruction to switch to the one-two phase excitation, the motor driver 611 drives the motor in the predetermined one-two phase excitation pattern. During the phase adjustment operation and the starting operation, the motor driver 611 maintains the excitation state without change. In this example, the excitation in the one-two phase excitation pattern of one cycle is performed as the phase adjustment. However, as long as the rotor 802 is positioned at the initial position in the one-two phase excitation pattern, excitation in the one-two phase excitation pattern of integral multiple of one cycle (multiple cycle excitation) may be performed.

FIG. 5B illustrates excitation control performed when the one-two phase excitation drive is switched to the two-phase excitation drive. When the one-two phase excitation is switched to the two-phase excitation, the phase adjustment to fully execute one cycle of the excitation pattern of the two-phase excitation at a predetermined frequency within the self-start frequency range is performed before the motor is started in the two-phase excitation. The CPU 700 stops the input clock at an arbitrary timing the conveyance operation in the one-two phase excitation ends. Then, the CPU 700 instructs the motor driver 611 to perform the two-phase excitation, and inputs 4 pulses of the input clock at the predetermined frequency within the self-start range to the motor driver 611.

In the two-phase excitation, the one cycle of the excitation pattern consists of four steps. Accordingly, by the transfer of the excitation pattern of the four steps, the rotor 802 becomes the state shown in FIG. 4A. Then, the state corresponds to the phase of the excitation pattern at the start of the two-phase excitation. Then, the CPU 700 lineally increases the frequency of the input clock from the self-start frequency to the target frequency.

The motor driver 611 drives the motor in the one-two phase excitation until an instruction to switch the one-two phase excitation to the two-phase excitation is issued. After receiving the instruction to switch to the two-phase excitation, the motor driver 611 drives the motor in the predetermined two-phase excitation pattern. During the phase adjustment operation and the starting operation, the motor driver 611 maintains the excitation state. In this example, the excitation in the two-phase excitation pattern of one cycle is performed as the phase adjustment. However, as long as the rotor 802 is positioned at the initial position in the two-phase excitation, excitation in the two-phase excitation pattern of integral multiple of one cycle (multiple cycle excitation) may be performed.

Figure 6:
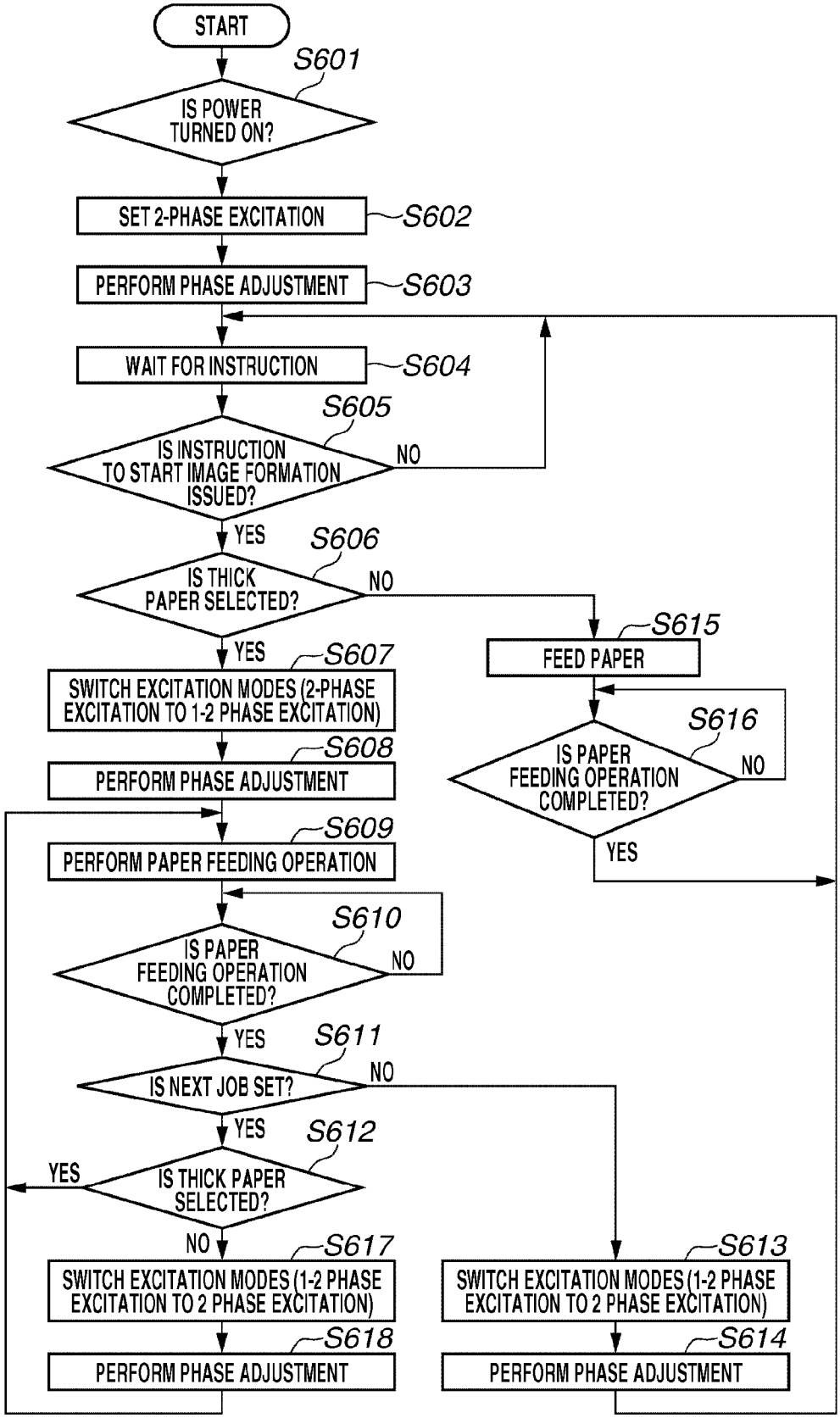
FIG. 6 is a flowchart illustrating control for motor control in a paper feeding operation according to an exemplary embodiment of the present invention.

FIG. 6 is a control flowchart illustrating motor control performed by the CPU 700 in the paper feeding operation. In step S601, when power of the image forming apparatus 100 is turned on, then in step S602, the CPU 700 sets the excitation mode of the motors 601, 602, and 603 to the two-phase excitation. When thick paper setting is selected, in order to reduce motor vibration by slowing the rotation speed of the motors, the motors are driven in the one-two phase excitation. However, thick paper is used significantly less frequently than plain paper. Accordingly, the two-phase excitation that is the excitation mode used to perform the feeding operation of plain paper is set as default.

In step S603, the phase adjustment is performed in the two-phase excitation to match the phases of the stator 804 and the rotor 802 in initial state. Then, in step S604, the CPU 700 waits for an instruction to perform an image forming operation from the operation unit 710. During this step, a user sets a mode for the image forming operation and the like via the operation unit 710. The contents of the setting are stored in the memory 720.

In step S605, when the instruction to start the image forming operation is issued from the operation unit 710 (YES in step S605), then in step S606, the CPU 700 determines whether the setting to feed thick paper is selected or not. When the thick paper is not selected (NO in step S606), in step S615, an operation to feed the recording paper from the specified paper feeding unit is performed in the two-phase excitation. In step S616, when the paper feeding operation (image forming operation) is completed, the operation returns to step S604.

In step S606, when the thick paper is selected (YES in step S606), in step S607, the excitation mode of the motors is switched from the two-phase excitation to the one-two phase excitation. In step S608, the phase adjustment operation is performed. In step S609, the operation to feed the recording paper from the specified paper feeding unit is performed in the one-two phase excitation. In step S610, when the paper feeding operation (image forming operation) is completed, in step S611, the CPU 700 refers to the memory 720, and determines whether setting for the next image forming operation (next job) is set or not.

In step S611, when the next image forming operation is set (YES in step S611), and in step S612, when the thick paper is selected (YES in step S612), the operation returns to step S609 in the state that the excitation mode is maintained as the one-two phase excitation. In step S611, when the next image forming operation is not set (NO in step S611), in step S613, the excitation mode is returned to the two-phase excitation. In step S614, the phase adjustment operation is performed, and the operation returns to step S604.

In step S611, even if the next image forming operation is set (YES in step S611), if the thick paper is not selected (NO in step S612), then in step S617, the excitation mode is switched to the two-phase excitation. In step S618, the phase adjustment operation is performed, and the operation returns to step S609. The excitation mode is returned to the two-phase excitation to minimize operation time necessary for an operation which is usually frequently performed than the thick paper setting when the next paper feeding operation is performed.

As described above, in the image forming apparatus that drives the rollers for conveying the recording paper by the stepping motors, the stepping motors are started after the phase adjustment operation is performed when the power is turned on and when the excitation mode is switched. Accordingly, the stepping motors can be surely started without causing a loss of synchronization or vibration. Further, according to the present exemplary embodiment, the phase adjustment is performed in the excitation mode which is usually frequently used, and whether to switch the excitation mode or not is determined based on an instruction of the image forming operation. Further, the phase adjustment is performed when the excitation mode needs to be switched, so that the frequency of occurrence of time delay due to phase adjustment can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-178016 filed Jul. 30, 2009, which is hereby incorporated by reference herein in its entirety.

What is claimed is:

1. A motor control apparatus comprising:

a stepping motor which includes a rotor and a stator;

a setting unit configured to set an excitation mode, the excitation mode including a first excitation mode in which a first excitation pattern is used and a second excitation mode in which a second excitation pattern is used; and a control unit configured to control the stepping motor based on the excitation mode set by the setting unit, wherein, in a case where the setting unit changes the excitation mode from the second excitation mode to the first excitation mode, the control unit performs phase adjustment corresponding to the first excitation mode by exciting the stator in the first excitation pattern by at least one cycle of the first excitation pattern with a drive pulse of a frequency within a self-start range of the stepping motor, and starts rotation drive of the stepping motor by exciting the stator in the first excitation pattern with a drive pulse of a target frequency which exceeds the self-start frequency of the stepping motor.

2. The motor control apparatus according to claim 1, wherein the first excitation pattern is a two-phase excitation pattern, and the second excitation pattern is a one-two phase excitation pattern.

3. The motor control apparatus according to claim 1, wherein the first excitation pattern is a one-two phase excitation pattern, and the second excitation pattern is a two-phase excitation pattern.

4. The motor control apparatus according to claim 1, wherein the control unit maintains an excitation state of the stator without change during a period from an end of the phase adjustment to a start of the rotation drive of the stepping motor.

5. An image forming apparatus comprising a motor control apparatus according to claim 1 and causing the stepping motor to drive rollers for conveying recording paper on which an image is formed.

6. The image forming apparatus according to claim 5, wherein the first excitation pattern is a two-phase pattern and the second excitation pattern is a one-two phase excitation pattern, and the setting unit sets the first excitation mode when first recording paper is conveyed, and sets the second excitation mode when second recording paper, which is thicker than the first recording paper, is conveyed.

7. The image forming apparatus according to claim 6, wherein the control unit performs the phase adjustment according to the two-phase excitation pattern in accordance with a power of the image forming apparatus being turned on.

8. The image forming apparatus according to claim 6, wherein the control unit performs the phase adjustment according to the two-phase excitation pattern in accordance with an image forming operation being completed and a next image forming operation not being set.

9. A motor control apparatus comprising:

a stepping motor which includes a rotor and a stator;

a setting unit configured to set an excitation mode, the excitation mode including a first excitation mode in which a first excitation pattern is used and a second excitation mode in which a second excitation pattern is used; and a control unit configured to control the stepping motor based on the excitation mode set by the setting unit, wherein, in a case where the setting unit changes the excitation mode from the second excitation mode to the first excitation mode, the control unit performs phase adjustment corresponding to the first excitation mode by exciting the stator in the first excitation pattern by at least one cycle of the first excitation pattern with a drive pulse of a frequency within a self-start range of the stepping motor, and starts rotation drive of the stepping motor by exciting the stator in the first excitation pattern with a drive pulse of a target frequency which exceeds the self-start frequency of the stepping motor, and in a case where the rotation drive of the stepping motor is started in the second excitation pattern, the control unit performs phase adjustment of the rotor by exciting the stator in the second excitation pattern by at least one cycle of the second excitation pattern with the drive pulse of the frequency within the self-start range of the stepping motor, and starts the rotation drive of the stepping motor by exciting the stator in the second excitation pattern to the target frequency which exceeds the self-start frequency of the stepping motor.

10. A motor control method comprising:

setting an excitation mode on a stepping motor which includes a rotor and a stator, the excitation mode including a first excitation mode in which a first excitation pattern is used and a second excitation mode in which a second excitation pattern is used;

controlling the stepping motor based on the set excitation mode; and in a case where the excitation mode is changed from the second excitation mode to the first excitation mode, performing phase adjustment corresponding to the first excitation mode by exciting the stator in the first excitation pattern by at least one cycle of the first excitation pattern with a drive pulse of a frequency within a self-start range of the stepping motor, and starting rotation drive of the stepping motor by exciting the stator in the first excitation pattern with a drive pulse of a target frequency which exceeds the self-start frequency of the stepping motor.

* * * * *